United States Patent [19]

Tanikella

[11] Patent Number: 4,748,065

[45] Date of Patent: May 31, 1988

[54] SPUNLACED NONWOVEN PROTECTIVE FABRIC

[75] Inventor: Murty S. S. R. Tanikella, Wilmington, Del.

[73] Assignee: E. I. Du Pont de Nemours and Company, Wilmington, Del.

[21] Appl. No.: 896,531

[22] Filed: Aug. 13, 1986

[51] Int. Cl.[4] ..... B41M 3/12

[52] U.S. Cl. ..... 428/152; 428/244; 428/283; 428/290; 428/323; 428/920

[58] Field of Search ..... 8/115.68; 252/502; 428/240, 283, 152, 244, 290, 323, 920

[56] References Cited

U.S. PATENT DOCUMENTS

| | | | |
|---|---|---|---|
| 3,797,074 | 3/1974 | Zafiroglu | 264/518 |
| 4,397,907 | 8/1983 | Rosser et al. | 428/240 |
| 4,510,193 | 3/1985 | Blücher et al. | 428/196 |
| 4,545,926 | 10/1985 | Fouts, Jr. et al. | 252/502 |
| 4,556,697 | 12/1985 | Curatolo | 528/331 |

*Primary Examiner*—Paul Lieberman
*Assistant Examiner*—John F. McNally

[57] ABSTRACT

A flame resistant and noxious chemical adsorbent, flexible, creped fabric suited for use as a protective garment is disclosed. The fabric is spunlaced and nonwoven and is impregnated with adsorbent carbonized particles.

6 Claims, No Drawings

SPUNLACED NONWOVEN PROTECTIVE FABRIC

DESCRIPTION

TECHNICAL FIELD

This invention relates generally to flame resistant and noxious chemical adsorbent flexible fabric, more particularly to a spunlaced fabric impregnated with adsorbent carbonized particles.

BACKGROUND

Typical chemical warfare protective clothing garments presently are two layer structures used as overgarments. The inner layer is a urethane foam impregnated with activated carbon powder reinforced with nylon tricot and the outer layer is a nylon/cotton (50/50 blend) fabric treated with a fabric fluoridizer. The garment is carried in a sealed package and once opened from the package generally has the following limitations: humidity, sweat, rain, etc. are adsorbed and the carbon powder loses capacity; the garment can typically be worn for only up to 14 days; once exposed to chemical gases the garment is typically good for only 6 hours; the garment is flammable; and the garment at 500 g/m$^2$ (15 oz/yd$^2$) or more is comparatively heavy allowing for less wear time in hotter weather and greater chance of causing heat stress to the wearer.

SUMMARY OF THE INVENTION

A flame resistant and noxious chemical adsorbent, flexible, creped fabric suited for use as a protective garment has now been discovered. The fabric comprises a spunlaced fabric substrate at least 90% by weight aramid staple fibers having a length between 0.75 and 10 cm and a linear density of from 1 to 6 decitex (dtex), said fabric having a weight in the range of from 35 to 70 g/m$^2$ and a thickness of 300 to 800 $\mu$m (micrometers). The fabric is impregnated with adsorbent carbonized particles having a particle size of less than 100 $\mu$m, preferably 4–50 $\mu$m, said particles being approximately uniformly distributed over the entire fabric, and dispersed throughout the cross-section of the fabric, but with more of the particles being located near the surface of the fabric, said particles being present in an amount of 20 to 120 g/m$^2$ of fabric. The adsorbent particles are held in place by an organic binder, said binder being present in the amount of 10–50% by weight, preferably 10–20% by weight, of the adsorbent particles. The aramid fibers in the fabric are selected from the group consisting of (a) polymetaphenylene isophthalamide fibers, (b) polyparaphenylene terephthalamide fibers, and (c) a blend of (a) and (b). The adsorbent carbonized particles in the fabric are preferably sulfonated styrene/polydivinyl benzene copolymer particles that have been carbonized.

The fabric of this invention can hold more adsorbent carbonized particles due to its spunlaced structure which makes it particularly suited for use in protective clothing. The lighter weight of the garment is especially important when considering the potential for high heat stress under the conditions these garments would be worn. The fabric of this invention would also be suited for patient wrap, and other medical applications, equipment covers, material used in tent construction, etc.

TEST METHODS

Air Permeability Test (ASTM D-737-75)

In Table I, the air permeability of the samples was determined by the Standard Method of Test for Air Permeability of Textile Fabrics, also known as the Frazier Air Porosity Test.

Air porosity or air permeability is the rate of air flow through a material under a differential pressure between the two fabric surfaces. Air permeability is expressed in cubic feet of air per minute per square foot of fabric at a stated pressure differential between the two surfaces of the fabric. Measurements reported herein were made at a differential water gauge pressure of 0.5 inches (1.27 cm) and converted to m$^3$/min./m$^2$.

Static Capacity Test

Ten-cm (four-inch) square specimens were cut from each of the three samples and dried at 100° C. and weighed. The specimens were hung by clips in a desiccator containing a pan of carbon tetrachloride ($CCl_4$). After 24 hours, the specimens were weighed and the amount of $CCl_4$ adsorbed was determined.

The specimens were then washed separately in isopropanol, stirred for 15 minutes, and dried at 100° C. This washing procedure was repeated five times. After the fifth wash cycle, the specimens were again exposed to $CCl_4$ for 24 hours to check static capacity. The results are shown in Table I.

EXAMPLE

Crystalline poly(m-phenylene isophthalamide) (MPD-I) fibers having a linear density of 1.65 dtex (1.5 dpf) were prepared as described in U.S. Pat. No. 3,133,138 (available as T-450 Nomex® aramid fibers from E. I. du Pont de Nemours and Co., Inc.). The MPD-I fibers were cut to staple fibers having a cut length of 1.9 cm (0.75 in.).

The staple fibers were formed into a batt by an airlaydown process of the type described in U.S. Pat. No. 3,797,074, and the batt was then formed into a spunlaced, nonapertured, nonwoven fabric having a nominal basis weight of about 50 g/m$^2$ (about 1.5 oz/yd$^2$) by a three-stage treatment with columnar hydraulic jets delivered from sets of orifices located about 2.5 cm (1 in.) from the batt surface. Each set of orifices was arranged in two staggered rows perpendicular to the direction of batt travel, the center lines of the orifices in the two rows being 0.1 cm (0.04 in.) apart, with each orifice having a diameter of 0.127 mm (0.005 in.) and being spaced midway between the two closest orifices in the other row. Within each row the orifices were spaced 7.9 per cm (20 per in.) in Orifice Set A and 11.8 per cm (30 per in.) in Orifice Set B.

During the treatment of the batt with columnar hydraulic jets of water from successive sets of orifices, the batt was supported on wire mesh screens, under which means were provided for removing the water. The batt was first given a light hydraulic needling at low pressure (about 1400 kPa) to consolidate it, after which the upper face of the batt was hydraulically needled at successively higher jet pressure (up to about 10,000–11,000 kPa), using Orifice Set A. The other face of the batt was then hydraulically needled first at low pressure and then at higher pressures, using Orifice Set A for the low pressure needling and the first high pressure needling, then Orifice Set B at about 11,000 kPa for the final needling.

The resulting spunlaced fabric having a basis weight of about 50 g/m² was brush coated on each side with an aqueous slurry mixture prepared by mixing the following slurries:

(a) 231 g of an aqueous slurry containing 12% solids of activated carbon absorber particles having an average particle size of about 50 micrometers (maximum particle size about 100 micrometers), prepared by crushing active carbon beads made by heating a sulfonated styrene divinylbenzene copolymer resin in a fluidized bed at about 600°-700° C. ("AMBERSORB XE-348" Absorbent, made by Rohm & Haas Co., Philadelphia, Pa.) and (b) 41.2 g of an aqueous slurry containing 42% solids of a synthetic copolymeric latex comprising a 26/74 polymer of ethyl acrylate and poly(vinylidene chloride/methyl acrylate/itaconic acid) (89/9/2).

After the spunlaced fabric was brush-coated on the first side, it was dried in an oven at 150° C. after which it was brush-coated on the other side then dried again in the oven. When dry, it was found to have picked up 150% by weight of the solids in the mixed slurry, based on the original weight of the fabric. The new basis weight of the brush-coated spunlaced fabric was about 125 g/m².

Three structures to be tested for static capacity and air permeability tests were then prepared as follows:

Sample 1. This sample was a single layer of the brush-coated spunlaced fabric prepared as described above.

Sample 2. Two layers of the brush-coated spunlaced fabric were used as the middle layers of a four-layer composite structure. One of the outside layers was a spunlaced fabric having a basis weight of 110 g/m² (3.3 oz/yd²), made from MPD-I fibers using the same procedure generally described in the first three paragraphs of this Example, except that a heavier batt of staple fibers was laid down. The other outside layer was a woven rip-stop fabric having a basis weight of 107 g/m² (3.2 oz/yd²), woven from 160 dtex (37 singles cotton count) spun yarn of 5-cm (2-inch), 2.2 dtex (2 dpf) crystalline MPD-I fibers and having 32 ends per cm (81 ends per inch) in the warp and 27 ends per cm (69 ends per inch) in the filling. The composite structure was stitched together using a yarn spun from MPD-I staple fibers.

Sample 3. A five-layer composite structure was made like the four-layer composite structure designated as Sample 2, except that three layers of the brush-coated spunlaced fabric were used as middle layers, the outside layers being the same 110 g/m²-spunlaced fabric and 100 g/m²-woven fabric used to make Sample 2.

The structures designated as Sample 1, Sample 2, and Sample 3 were creped by passing them separately through a pair of fluted rolls which meshed together in a manner similar to gear crimping. The structures were softened, made more flexible, and had improved textile fabric aesthetics.

The spunlaced fabric substrates employed in the present invention are much more suitable than woven fabrics in picking up and supporting the absorbent carbonized particles and organic binder impregnants, in that a much lighter weight of the spunlaced fabric can be used for a given weight of impregnant. Table II illustrates the coating pick-up (based on dried fabric) of a 40 g/m² spunlaced fabric of MPD-I fibers, made by the procedure generally described in the first three paragraphs of the Example, with the coating pick-up of woven fabrics having basis weights of 93 g/m² and 160 g/m², woven from spun yarns of aramid staple fibers. The fabric having the basis weight of 93 g/m² was a woven rip-stop fabric of MPD-I staple fibers like the one used as the outside layer in Sample 2, except for its slightly lower basis weight. The fabric having the basis weight of 160 g/m² was a plain-weave woven fabric made from a 394 dtex (30/2 cotton count) spun yarn of a 95/5 blend of 3.8 cm (1.5 in.), 1.9 dtex (1.7 dpf) crystalline MPD-I fibers and 3.8 cm (1.5 in.), 1.7 dtex (1.5 dpf) poly(p-phenylene terephthalamide) fibers, prepared as described in U.S. Pat. No. 3,767,756 to Blades (available as Type 29 Kevlar® aramid fiber from E. I. du Pont de Nemours and Company). The spunlaced fabric and the woven fabrics were coated in identical manner on one side only and then oven-dried, using the same aqueous slurry mixture described above in the Example.

TABLE I

STATIC CAPACITY AND AIR PERMEABILITY RESULTS

| | Sample 1 | Sample 2 | Sample 3 |
|---|---|---|---|
| Air Permeability ($m^3min/m^2$) | 54.9 | 14.2 | 11.8 |
| Initial Static Capacity ($mg/cm^2$) | 1.40 | 3.05 | 3.89 |
| Static Capacity After 5 Wash Cycles ($mg/cm^2$) | 1.60 | 3.72 | 4.41 |

TABLE II

| Fabric | Thickness of Coated Fabric, mm | Coating Pick-up | |
|---|---|---|---|
| | | Actual Wt., g/m² | % Pick-up Based on Fabric Weight |
| 40 g/m² spunlaced fabric | 0.48 | 30 | 75% |
| 93 g/m² woven fabric | 0.38 | 20.7 | 22.2% |
| 160 g/m² woven fabric | 0.64 | 47.3 | 29.6% |

I claim:

1. A flame resistant and noxious chemical adsorbent, flexible, creped fabric comprising:

(a) a spunlaced fabric substrate comprising at least 90% by weight aramid staple fibers having a length between 0.75 and 10 cm, said fabric having a weight in the range of 35 to 70 g/m² and a thickness of 300 to 800 μm;

(b) said fabric being impregnated with adsorbent carbonized particles having a particle size less than 100 μm, said particles being approximately uniformly distributed over the entire fabric, and dispensed throughout the cross section of the fabric, said particles being present in an amount of 20 to 120 g/m² of fabric;

(c) said adsorbent particles being held in place in the fabric by a synthetic copolymeric latex organic binder, said binder being present in the amount of 10 to 50% by weight of the adsorbent particles.

2. The fabric of claim 1 in which the aramid fibers are selected from the group consisting of (a) polymetaphenylene isophthalamide fibers, (b) polyparaphenylene terephthalamide fibers, and blend of (a) and (b).

3. The fabric of claim 2 in which the adsorbent carbonized particles are sulfonated styrene/polydivinyl benzene copolymer particles that have been carbonized.

4. The fabric of claim 3 in which the binder is present in the amount of 10–20% by weight of the adsorbent particles.

5. The fabric of claim 4, in which the staple fibers have a linear density of 1 to 6 decitex.

6. The fabric of claim 5 in which the adsorbent carbonized particles have a particle size of 4–50 μm.

* * * * *